United States Patent [19]

Sakakibara et al.

[11] Patent Number: 4,466,410

[45] Date of Patent: Aug. 21, 1984

[54] AIR-FUEL RATIO CONTROL FOR INTERNAL COMBUSTION ENGINE

[75] Inventors: Shuji Sakakibara; Toshio Kondo; Akio Kobayashi; Shigenori Isomura, all of Kariya, Japan

[73] Assignee: Nippondenso Co., Ltd., Kariya, Japan

[21] Appl. No.: 398,275

[22] Filed: Jul. 14, 1982

[30] Foreign Application Priority Data

Jul. 15, 1981 [JP] Japan ..... 56-110385
Jul. 20, 1981 [JP] Japan ..... 56-113268
May 24, 1982 [JP] Japan ..... 57-88289

[51] Int. Cl.[3] ..... F02B 3/00; F02M 7/00

[52] U.S. Cl. ..... 123/440; 123/489; 123/480

[58] Field of Search ..... 123/440, 489, 480, 486

[56] References Cited

U.S. PATENT DOCUMENTS 4,130,095 12/1978 Bowler ..... 123/440
4,200,064 4/1980 Engele ..... 123/440
4,235,204 11/1980 Rice ..... 123/440
4,271,804 6/1981 Bianchi ..... 123/440
4,279,230 7/1981 Baur ..... 123/440
4,319,451 3/1982 Tajima et al. ..... 123/440

*Primary Examiner*—Ronald B. Cox
*Attorney, Agent, or Firm*—Cushman, Darby & Cushman

[57] ABSTRACT

In an air-fuel ratio control system for an internal combustion engine, the basic fuel injection amount computed from engine parameters such as engine speed and intake air flow is corrected by using map having air-fuel ratio compensation data stored battery back-up in accordance with the engine parameters. The compensation data is read out of the map in accordance with the parameters at the time of detection of the stable combustion state of the engine. When an output of an oxygen sensor is on lean side, a predetermined amount is added to the data thus read, while when the output of the oxygen sensor is on rich side, a predetermined amount is subtracted from the data thus read, thereby renewing the stored value.

13 Claims, 18 Drawing Figures

| Q \ N | 1 | 2 | 3 | --- | --- | n-2 | n-1 | n | n+1 | n+2 | | | |
|---|---|---|---|---|---|---|---|---|---|---|---|---|---|
| 1 | $K_1^1$ | $K_2^1$ | $K_3^1$ | | | | | | | | | | |
| 2 | $K_1^2$ | $K_2^2$ | $K_3^2$ | | | | | | | | | | |
| 3 | $K_1^3$ | $K_2^3$ | $K_3^3$ | | | | | | | | | | |
| ⋮ | | | | | | | | | | | | | |
| m-1 | | | | | | $K_{n-2}^{m-1}$ | $K_{n-1}^{m-1}$ | $K_n^{m-1}$ | $K_{n+1}^{m-1}$ | $K_{n-2}^{m-1}$ | | | |
| m | | | | | | $K_{n-2}^{m}$ | $K_{n-1}^{m}$ | $K_n^{m}$ | $K_{n+1}^{m}$ | $K_{n+2}^{m}$ | | | |
| m+1 | | | | | | $K_{n-2}^{m+1}$ | $K_{n-1}^{m+1}$ | $K_n^{m+1}$ | $K_{n+1}^{m+1}$ | $K_{n+2}^{m+1}$ | | | |
| ⋮ | | | | | | | | | | | | | |
| ⋮ | | | | | | | | | | | | | |

AIR-FUEL RATIO CONTROL FOR INTERNAL COMBUSTION ENGINE

BACKGROUND OF THE INVENTION

The present invention relates to an air-fuel control in which the actual air-fuel ratio is detected and is controlled by feedback to the level of the mixture gas supplied to the engine.

In conventional methods so far suggested, in addition to the integration processing control by the output of an air-fuel ratio sensor, a value corresponding to the integration data is stored as correction data or learning value for each condition of the engine so that the air-fuel ratio is controlled by feedback by means of the learning data corresponding to the prevailing engine condition among the correction data thus learned and the integration data associated therewith.

According to the conventional methods, however, the learning is effected always even during unstable state of the engine, and therefore even undesirable data are stored with the result that the air-fuel ratio fluctuates or the engine operability is adversely affected.

SUMMARY OF THE INVENTION

Accordingly, it is an object of the present invention to provide a method of air-fuel ratio control in which only when the engine combustion is comparatively stable, the value corresponding to the integration data of the air-fuel ratio sensor is stored as correction data, whereby the air-fuel ratio is controlled thereby to control the air-fuel ratio accurately without adversely affecting the exhaust gas and engine operability.

DESCRIPTION OF THE PREFERRED EMBODIMENTS

Figure 1:
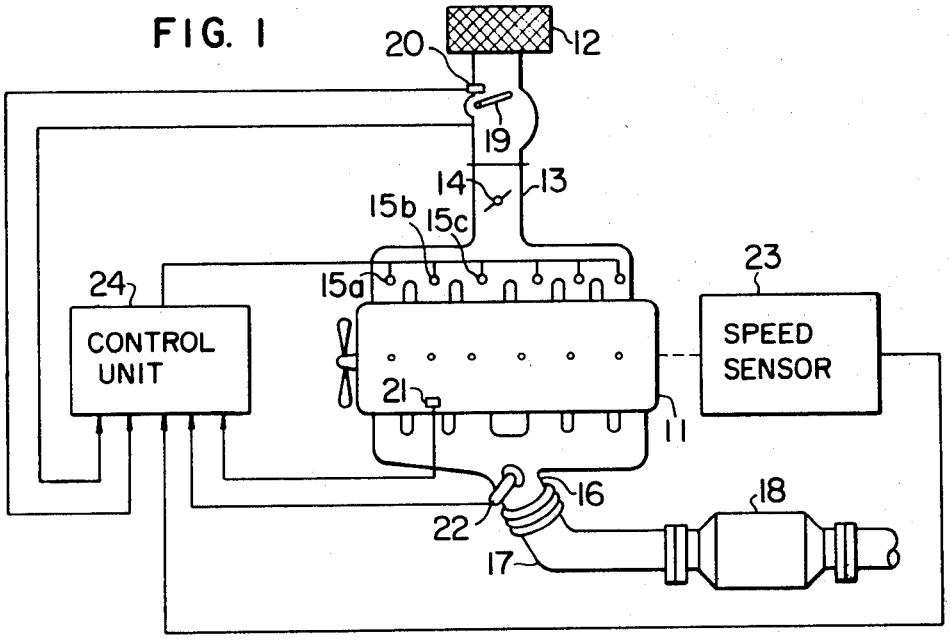
FIG. 1 is a diagram showing a general configuration of an engine applied to the present invention.

An embodiment of the present invention will be explained with reference to the drawings. A general construction of an engine is schematically shown in FIG. 1. The engine 11 is a well-known four-cycle engine of spark ignition type mounted on an automotive vehicle, which takes air required for combustion through an air cleaner 12, an intake pipe 13 and a throttle valve 14. The fuel is supplied through electromagnetic fuel injection valves 15*a*, 15*b* . . . provided for respective cylinders from a fuel system not shown. The exhaust gas resulting from burning of the mixture is discharged to the atmosphere through an exhaust manifold 16, and exhaust pipe 17 and a three-way catalyst converter 18, etc. The intake pipe 13 is provided with an intake amount sensor 19 of potentiometer type for detecting intake air quantity sucked into the engine 11 and producing an analog voltage corresponding to the air quantity. Also, an intake air temperature sensor 20 of thermistor type is mounted in the intake pipe 13 for detecting the temperature of the air sucked into the engine 11 and for producing an analog voltage (an analog detection signal) corresponding to the temperature of the sucked air. The engine 11 is provided with a water temperature sensor 21 of thermistor type for detecting the temperature of cooling water and for producing an analog voltage (an analog detection signal) corresponding to the temperature of the cooling water. Further, in the exhaust manifold 16 an air-fuel ratio sensor 22 is mounted for detecting the air-fuel ratio from the content of oxygen in the exhaust gas and for producing a voltage of about 1 volt (high level) when the air-fuel ratio is smaller (rich) than a stoichiometric air-fuel ratio and a voltage of about 0.1 volt (low level) when the air-fuel ratio is larger (lean) than the stoichiometric air-fuel ratio. An engine speed sensor 23 detects the rotational speed of the engine crankshaft and produces a pulse signal of a frequency corresponding to the engine speed. The engine speed sensor 23 may comprise an ignition coil of an ignition system using an ignition pulse signal from the primary winding of the ignition coil as an engine speed signal. The detection signals of the sensors 19 to 23 are applied to a control circuit which computes the fuel injection amount on the basis of the detection signals of the sensors 19 to 23. The fuel injection amount is regulated by controlling the valve opening duration of the injection valves 15*a* to 15*n*.

Figure 2:
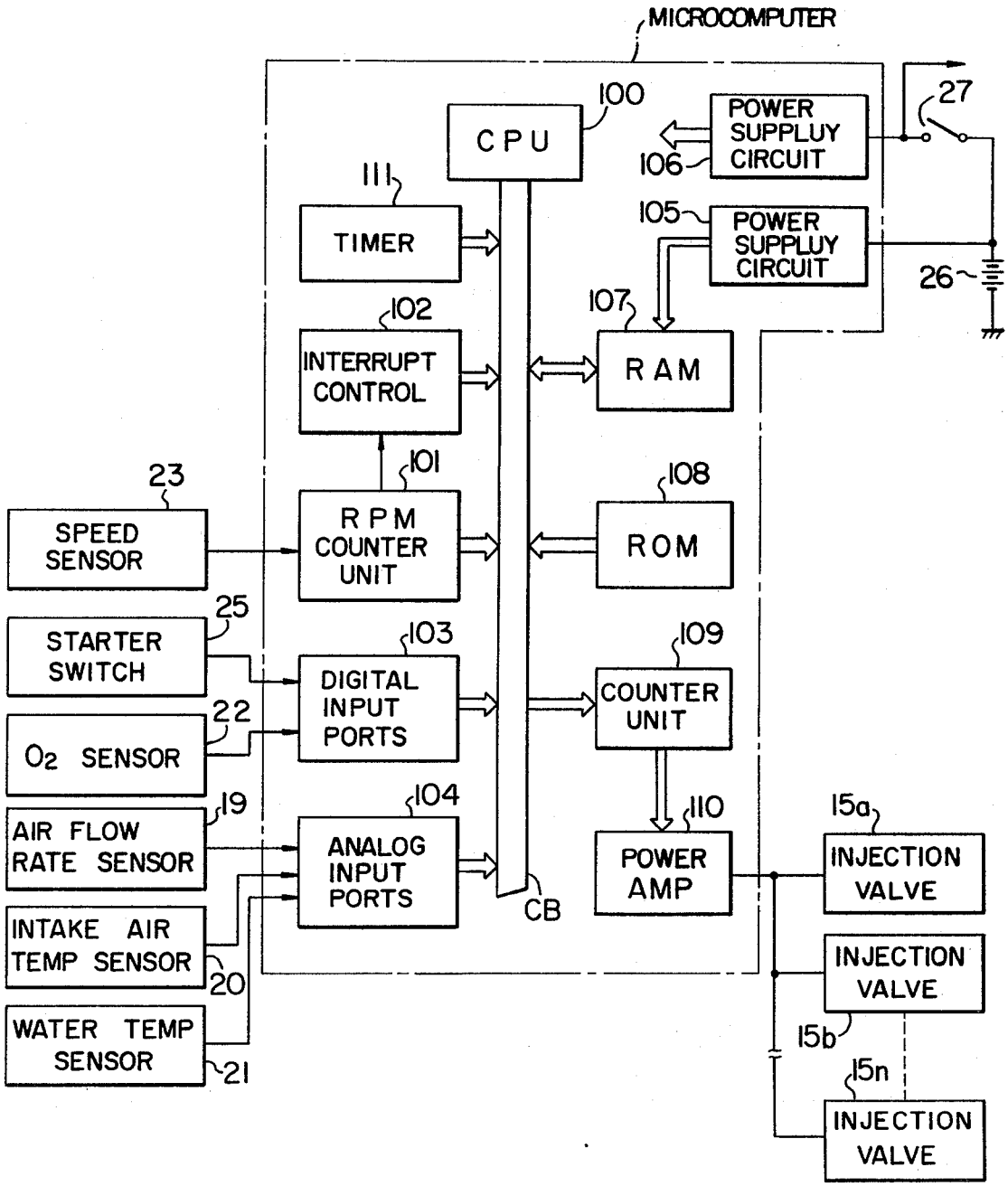
FIG. 2 is a block diagram showing the control circuit of FIG. 1.

The control circuit 24 will be explained with reference to FIG. 2. Numeral 100 designates a microprocessor (CPU) for computing the fuel injection amount. Numeral 101 designates an engine speed counter for counting the engine speed from the signal produced by the sensor 23. The counter 101 applies an interruption command signal to an interruption control unit 102 in syncronism with the engine revolutions. Upon receipt of this signal, the interruption control unit 102 applies an interruption signal to the microprocessor 100 through a common bus CB. Numeral 103 designates a digital input port for transferring to the microprocessor 100 digital signals such as the output signal of the $O_2$ sensor 22 and a starter signal from a starter switch 25 for turning on and off a starter not shown. Numeral 104 designates an analog input port including an analog multiplexer and an A/D converter. The analog input port 104 has a function of A/D converting the singlas from the intake air flow sensor 19, the intake air temperature sensor 20 and the cooling water temperature sensor 21 and causing the signals to be read into the microprocessor 100 sequentially. Numeral 105 designates a power supply circuit for supplying power from a battery 26 directly to a RAM 107 described later. The battery 26 includes a key switch 27, the power circuit 105 being connected directly to the battery 26 but not through the key switch 27. Thus, the RAM 107 is supplied with power all the time regardless of the state of the key switch 27. Numeral 106 also designates a power supply circuit connected to the battery 26 through the key switch 27. The power supply circuit 106 supplies power to the other units than the RAM 107. The RAM 107 is a temporary read/write memory unit used temporarily during the programmed operation of the microprocessor 100, and makes up a non-volatile memory so constructed that, with power applied thereto always regardless of the conditions of the key switch 27 as described above, the data stored therein is not lost by turning off of the key switch 27 to stop the engine operation. The second compensation amount $K_3$ is also stored in the RAM 107. Numeral 108 designates a read only memory (ROM) for storing a program and various constants. Numeral 109 designates a fuel injection period control counter including a register. This fuel injection period control counter 109 includes a down counter and converts a digital signal representing the fuel injection amount, namely, the open duration of the electromagnetic fuel injection valves 15*a*, 15*b* . . . computed at the microprocessor 100 into a pulse signal representing the actual open duration of the electromagnetic fuel injection valves 15*a* to 15*n*. Numeral 110 designates a power amplifier unit for actuating the fuel injection valves, and numeral 111 designates a timer for measuring the lapse of time and applying the measurement to the microprocessor 100.

In response to the output of the engine speed sensor 23, the RPM counter 101 measures the engine speed for, say, each revolution of the engine, and upon completion of the measurement, supplies an interruption command signal to the interruption control unit 102. The interruption control unit 102 generates an interruption signal in response to the interruption command signal and causes the microprocessor 100 to execute the interruption processing routine for computing the fuel injection amount.

Figure 3:
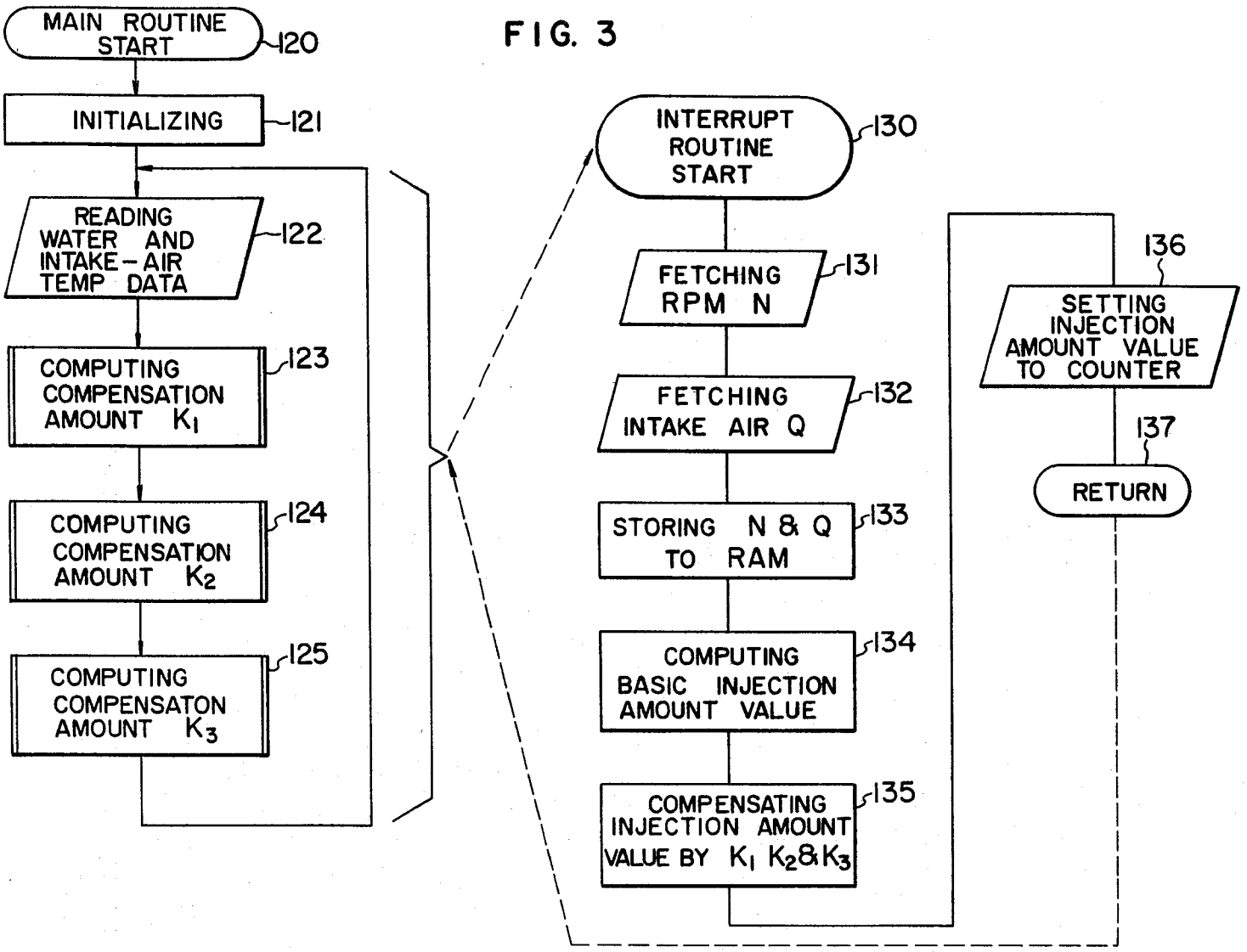
FIG. 3 is a general flowchart for the microprocessor shown in FIG. 2.

A flowchart for the microprocessor 100 is schematically shown in FIG. 3. The functions of the microprocessor 100 and the general operation of the control unit will be described with reference to this flowchart. When the engine is started by turning on the key switch 27 and the starter switch 25, the computation processing of the main routine is started upon generation of a start command at the first step 120. An initialization process is executed at step 121, and at step 122, digital values corresponding to the temperatures of the cooling water and the intake air are read from the analog input port 104. The result of this reading is used at step 123 to compute the compensation amount $K_1$, the result of which is stored in the RAM 107. At step 124, the output signal of the air-fuel ratio sensor 22 is introduced from the digital input port, the compensation amount $K_2$ is changed as a function of the lapse of time measured on the timer 111, and the thus obtained compensation amount $K_2$, namely, an integrated data is stored in the RAM 107.

Figure 4:
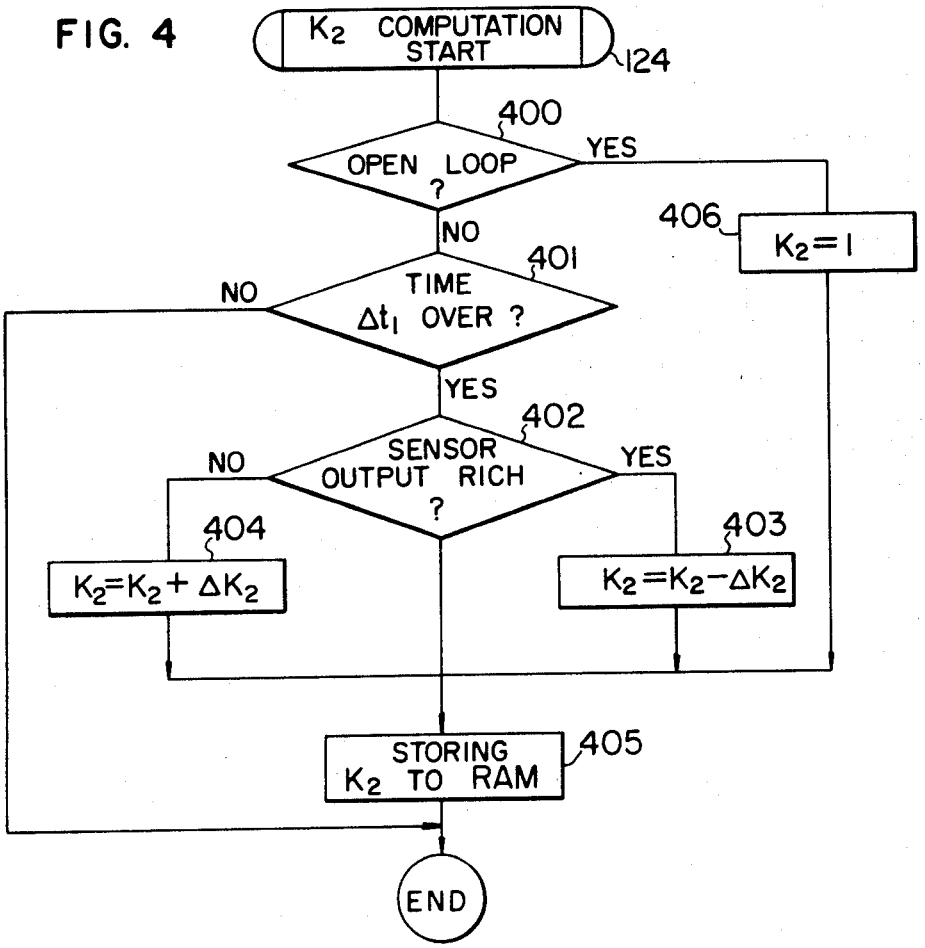
FIG. 4 is a detailed flowchart for the steps for obtaining the compensation amount $K_2$ shown in FIG. 3.

The flowchart of FIG. 4 shows in detail the processing step 124 for changing or integrating the compensation amount $K_2$ as an integrated data. The process starts at step 400 where it is decided whether or not the air-fuel ratio sensor is active, or the feedback control of the air-fuel ratio is possible from the temperature of the cooling water. If the feedback control is impossible, namely, if the control loop is open, the compensation amount $K_2$ is fixed to set value of 1 at step 406, followed by step 405. If the feedback control is possible, the process is passed to step 401, where it is decided whether or not the time after the execution of the step 405 has exceeded the unit time $\Delta t_1$, and if it has not exceeded, or if NO, the processing step 124 is ended without changing the value of $K_2$. After the lapse of time $\Delta t_1$, and if YES, the process proceeds to the step 402 where the output of the air-fuel sensor 22 is determined. In the case where the output of the sensor 22 is a high level signal indicative of a rich state of the mixture, the process advances to the step 403, where the value of $K_2$ determined in the preceding cycle is reduced by $\Delta K_2$, and at step 405 this new compensation amount $K_2$ is stored in RAM 107. If it is determined at step 402 that the output of the sensor 22 is a low level signal indicating a lean state of the mixture, the process is passed to step 404, where the value of $K_2$ is increased by $\Delta K_2$ followed by step 405. In this way, the compensation amount $K_2$ is increased or decreased. At the step 125 in FIG. 3, the compensation amount $K_3$ is computed and the result of computation is stored in RAM 107.

Figure 5:
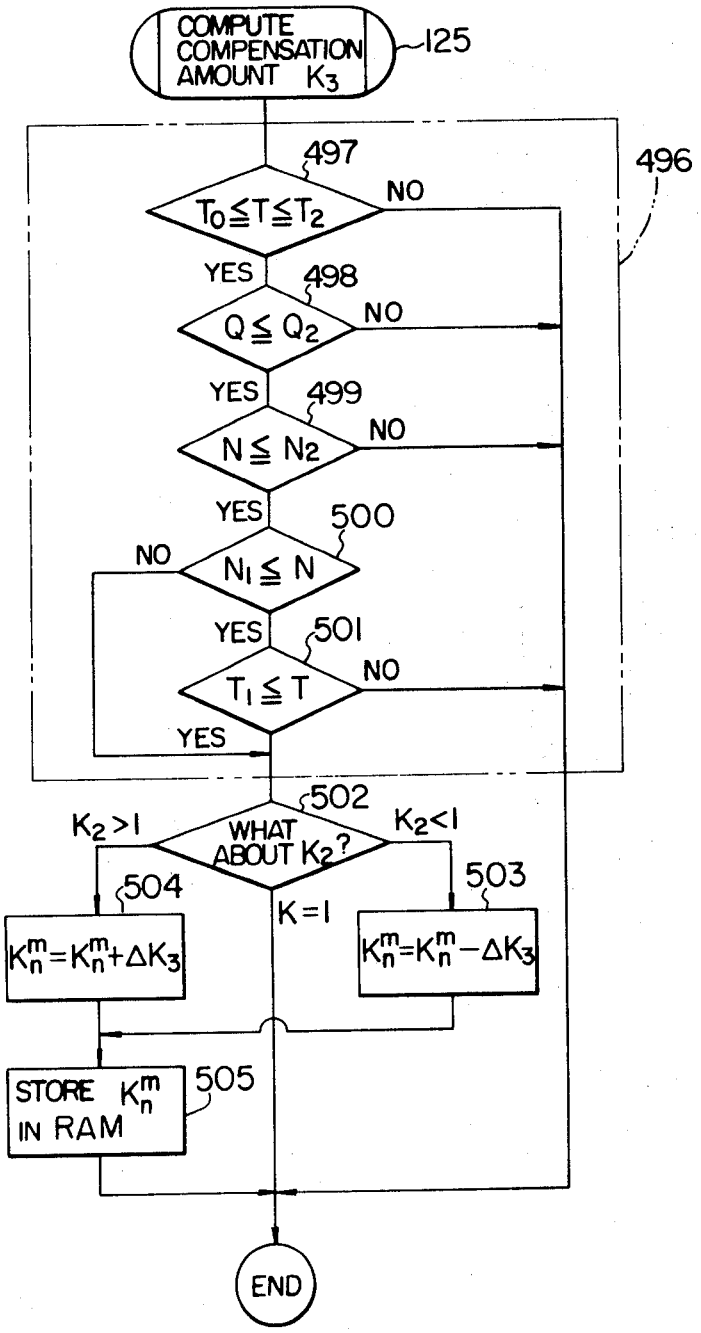
FIG. 5 is a detailed flowchart for the steps for obtaining the compensation amount $K_3$ shown in FIG. 3 according to an embodiment of the present invention.

FIG. 5 shows a detailed flowchart of step 125 for processing and storing or storing the compensation amount $K_3$. Prior to explanation of this flowchart, description will be made of the conditions for defining the region (engine condition) where "the engine combustion is comparatively stable" for the storage purpose. An object of processing of the compensation amount $K_3$ is to make the basic air-fuel ratio (basic fuel amount) based on the basic processing as identical as possible to the target air-fuel ratio (required fuel amount) currently required by the engine by continuous correction without feedback control, thus improving the response at the time of engine transient operations when the feedback control of the air-fuel ratio does not function satisfactorily, compensating for the secular variations or variations in characteristics of the parts compensating for the change of atmospheric pressure at highlands without using an atmospheric pressure sensor or in the absence of feedback control of the air-fuel ratio.

Figures 6, 7:
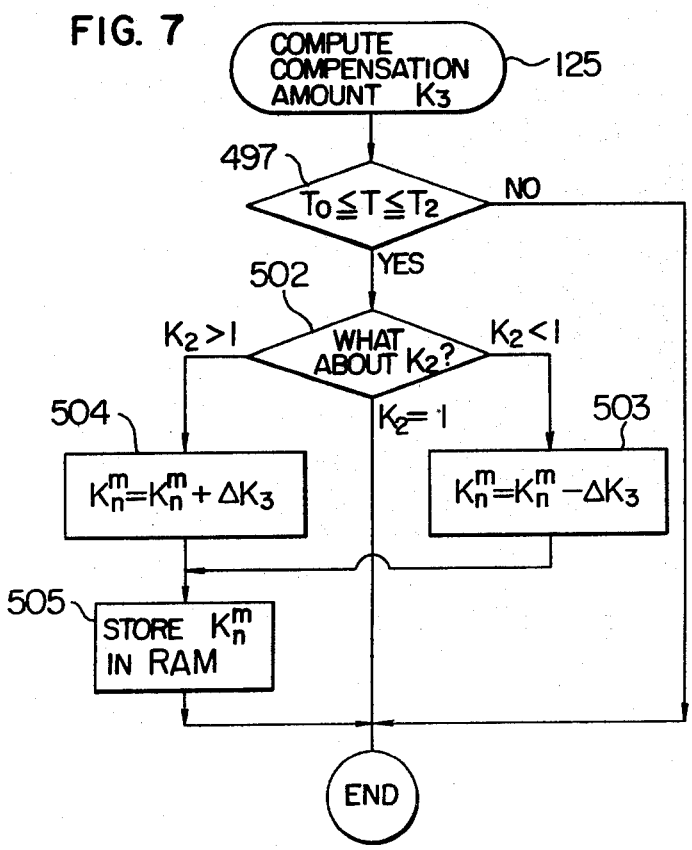
FIG. 6 is a map of the compensation amount $K_3$ used for explaining the embodiment under consideration.
FIGS. 7 to 11 are flowcharts for explaining the operation of other embodiments of the present invention respectively.

In view of the fact that the engine conditions greatly fluctuate in normal operating range and are especially very unstable in transient periods or at the time of output increase, it is not desirable to detect the engine conditions under such an unstable state to process the compensation amount $K_3$. According to the embodiment under consideration, as shown in FIG. 6, a map of the compensation amount $K_n^m$ assigned with the engine speed N and the intake air amount Q is used as the compensation amount $K_3$ and is rewritten. Once a value associated with unstable combustion is stored, the value $K_n^m$ thus stored is likely to be used under other operating conditions (such as steady running), in which case the air-fuel ratio may fluctuate or the operability may be extremely affected adversely. It is therefore very important to process the compensation amount $K_3$ under the conditions where the engine combustion is comparatively stable.

In the embodiment under consideration, the conditions for decision shown in FIGS. 12 to 15 and FIGS. 16 to 18 are taken into consideration.

Figure 12:
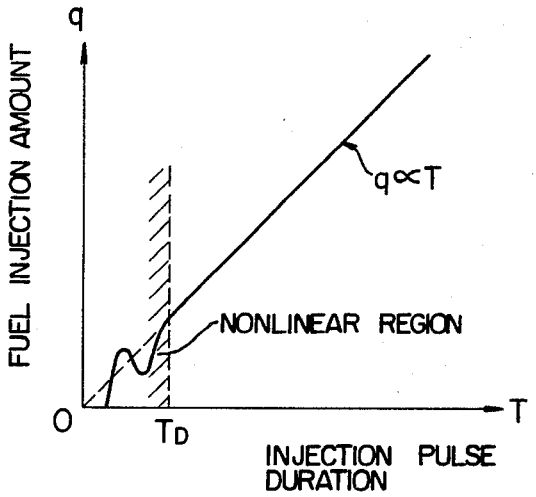
FIGS. 12 to 15 are diagrams for explaining the defining of specific operating regions.

First, consider the case in which the injection pulse duration applied to the electromagnetic fuel injection valve for giving a mixture gas is very small. FIG. 12 shows the relation between the injection pulse duration T applied to the electromagnetic fuel injection valve and the injection amount q. Generally, the injection pulse duration T and the injection amount q are given as a primary function (linear). When the pulse duration T is very small (for example, smaller than the pulse duration $T_0$), the linearity of the relation between the pulse duration T and the injection amount q is lost by the causes attributable to the construction and accuracy of the injection valve. The value $T_0$ is set to a level sufficiently small as compared with the injection pulse duration $T_D$ for idling. It is thus not desirable to store the correction data associated with the operating conditions using such a small pulse duration ($T<T_0$). The lower limit value $T_0$ may of course have different values depending on the injection valve or the fuel supply system involved. This boundary condition corresponds to the boundary (a) in FIG. 15. The point A in FIG. 15 indicates the idling state having the idling speed of $N_D$ and the injection pulse duration of $T_D$.

Figure 13:
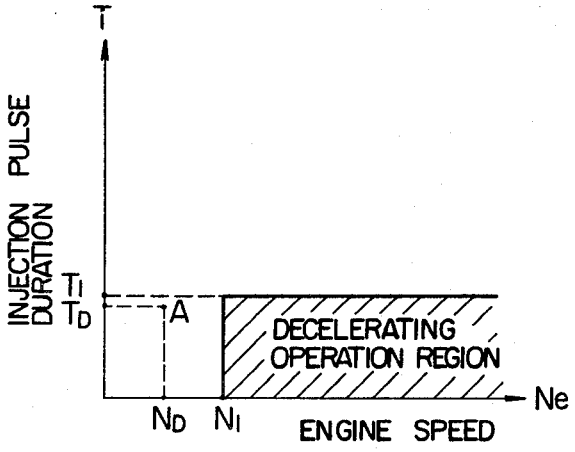
Figure 14:
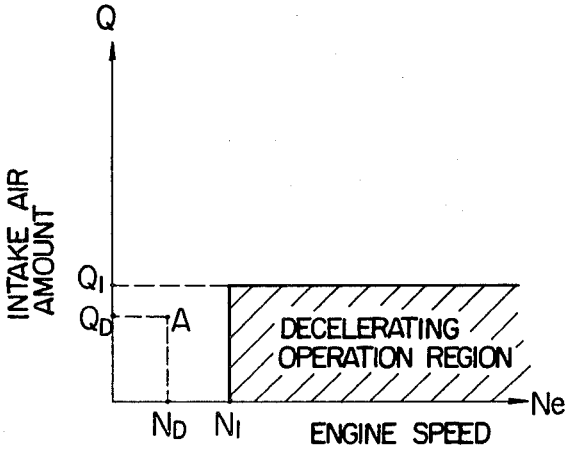

A second consideration to be taken in the fact that the air-fuel ratio is likely to be disturbed at the time of deceleration without stopping fuel supply to the engine. It is not desirable to store the compensation data associated with the operating region used for the deceleration as shown in FIG. 13 or 14 where the engine speed is higher than the predetermined value $N_1$ and the injection pulse duration or the intake air amount is smaller than the predetermined value $T_1$ or $Q_1$ respectively.

In consideration of the variations of the idling speed $N_D$ and in order for the engine speed not to exceed the value $N_1$ at the time of idle-up due to the drive of auxiliary equipment such as an air conditioner, the engine speed $N_1$ is preferably set to a level slightly higher than the idling speed $N_D$ (for instance, to about 1000 to 1200 rpm if the idling speed is 700 rpm). The decision pulse duration $T_1$ (or intake air amount $Q_1$ for deceleration may be set arbitrarily according to the degree of deceleration and may of course take a different value for each engine. This boundary condition corresponds to the boundary (b) in FIG. 15.

Thirdly, the air-fuel ratio may be made richer when the engine is run at high speed or large load in what is called an output increase, or in order to reduce the cobustion temperature or exhaust temperature. It is therefore not desirable to store the compensation data when a predetermined intake air amount $Q_2$, the engine speed $N_2$ or injection pulse duration $T_2$ has been exceeded.

The values $T_2$, $Q_2$ and $N_2$ may be set as desired in consideration of the above-mentioned facts and may of course take different values according to the types of engine involved.

Figure 15:
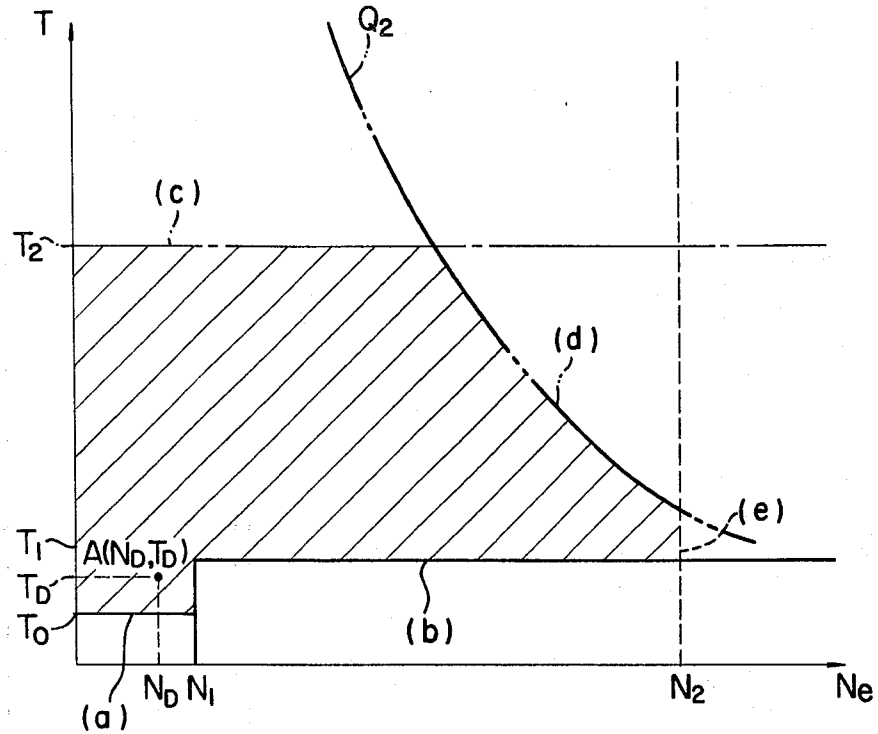

These boundary conditions are represented by the boundaries (c), (d) and (e) in FIG. 15 respectively. The hatched area surrounded by the boundaries (a), (b), (c), (d) and (e) shown above correspond to what is called "the condition where the engine combustion is comparatively stable." Even in this region, the combustion may be unstable when the engine is being warmed up, when the feed-back control of the air-fuel ratio is suspended, when the engine condition has just entered this region from outside, when the fuel has been increased in this region, or when the throttle switch is turned on. In any of such cases, the storage of the compensation amount $K_3$ is prohibited as required. This condition may of course be changed according to the required accuracy of the air-fuel ratio or frequency of storage operation.

Now, the storage operation of the compensation amount $K_3$ will be explained with reference to the flowchart shown in FIG. 5. The block 496 is for deciding whether or not the engine combustion is comparatively stable.

First, step 497 decides whether or not the injection amount at the fuel injection valves 15*a*, 15*b* and so on or the pulse duration T applied to the fuel injection valves 15*a*, 15*b* and so on is within a set range ($T_0 \leqq T \leqq T_2$). If it is other than the set range the step 125 is completed, while if it is within the set range, the process is passed to step 498. At step 498, it is decided whether or not the air amount Q detected by the intake amount sensor 19 is within a set value ($Q \leqq Q_2$), and if it is within the set value, the process is passed to step 499. Step 499 decides whether or not the engine speed N detected by the rotational speed sensor 23 is within a set value ($N \leqq N_2$). If it is not included in the set value, the step 125 is completed, while if it is included in the set value, the process is passed to step 500. Step 500 decides whether or not the engine speed is within a set value ($N_1 \leqq N$). If it is not included within the set value the process is passed to step 502, while if it is included in the set value, the process is passed to step 501. At step 501, it is decided whether or not the injection pulse duration T is included in a set value ($T_1 \leqq T$). If the pulse duration T is smaller than $T_1$, the step 125 is completed, while if it is longer than $T_1$, the process proceeds to step 502 thereby to determine the value of $K_2$.

If $K_2=1$, no action is taken but the processing step 125 is completed. The compensation amount $K_3$ forms a map as shown in FIG. 6 by the intake amount Q and the engine speed N in such a manner that the compensation amount $K_3$ corresponding to the m-th intake amount Q and the n-th engine speed N is expressed as $K_n^m$ on the map. In this embodiment, the map in the RAM 107 is divided into 32 parts at intervals of 200 rpm for the engine speed N and from idle to full throttle opening for the intake air amount Q. If $K_2$ is smaller than 1 at step 502, the process is passed to step 503 where $K_n^m$ is reduced by $\Delta K_3$, followed by step 505 for storing the result of reduction in the RAM 107. If $K_2$ is larger than 1 at step 502, the process proceeds to step 504 where the compensation $K_n^m$ determined in the preceding cycle is increased by $\Delta K_3$, followed by step 505 where the processing step 125 is completed. Upon completion of the step 125 of the main routine, the process is returned to step 122.

In the initializing process at step 121, the processes described below are also executed. In view of the fact that the battery may be removed for the purpose of car inspection or repair, the compensation amount $K_3$ stored in the RAM 107 may be destroyed to a meaningless value. In order to detect whether or not the battery is removed, therefore, a constant of a predetermined pattern is stored generally beforehand at a specified address of the RAM 107. When the program is started, it is decided whether or not this constant is destroyed, that is, whether it is an erroneous value or not, and if it is an erroneous value, the battery is considered to have been removed, so that all the values of the compensation amount $K_3$ are initialized to "1" thereby to reset the constant of the predetermined pattern. If the pattern constant is not destroyed at the next starting time, the value of $K_3$ is not initialized.

Normally, the processing of the main routine from steps 122 to 125 is repeatedly executed according to a control program. Upon receipt of the interruption signal for computation of the fuel injection amount from the interruption control unit 102 in FIG. 2, the microprocessor 100 suspends the process of the main routine and immediately transfers its execution to the interruption processing routine of step 130 irrespectively of the microprocessor executing any of the steps of the main routine. At step 131, a signal representing the engine speed N is fetched from the RPM counter 101, and at the next step 132, a signal representing the intake air quantity Q is fetched from the analog input port 104. At step 133, the engine speed N and the intake air quantity Q are stored in RAM 107 for using the same as parameters for storage of the compensation amount $K_3$ at the main routine. At step 134, the basic fuel injection amount (fuel injection time width t of the electromagnetic fuel injection valves 15*a*, 15*b*, . . . ) is computed from the engine speed N and the intake air quantity Q according to the equation $t=F\times Q/N$ (where F designates a constant). Then, at step 135, the compensation amounts for fuel injection, determined in the main routine, are read from RAM 107, and a compensated fuel injection amount (fuel injection time width), which determines the air-fuel ratio, is computed according to the equation $T=t\times K_1\times K_2\times K_3$. At step 136, the data on the compensated fuel injection amount thus computed is set in the counter 109. The process is then passed to step 137 where the main routine is restored. In restoring the main routine, the process is returned to the processing step where process has been suspended by the interruption process.

The general functions of the microprocessor 100 are as described above.

As seen above, a number of second compensation amounts $K_3$ ($=K_n^m$) are provided according to the intake air amount and engine speed, and therefore it is possible to use a proper compensation amount corresponding to the engine operating conditions immediately, thereby permitting a highly responsive control under all operating conditions. Further, since the second compensation amount $K_3$ is corrected according to the operating condition, automatic correction is possible against the secular variations or degeneration of the engine or the sensors.

In the aforementioned embodiment, if the engine is operated continuously under the same condition, the correction will be made only on the same one of the compensation amounts $K_3$, or $K_n^m$, with the result that the difference in value between $K_n^m$ and the adjacent $K_{n+1}^{m+1}$ or $K_{n-1}^{m-1}$ becomes excessive. It is thus possible to learn and correct the adjacent compensation amounts to $K_n^m$ at the same time. In this case, the computation process of the compensation amount $K_3$ at step 125 in the main routine of the aforementioned embodiment is programmed in such a manner that the step 504 in FIG. 5 executes the process.

$$K_n^m=K_n^m+3\Delta K_n$$

$$K_{n\pm1}^{m\pm1}=K_{n\pm1}^{m\pm1}+2\Delta K_n$$

$$K_{n\pm1}^{m\pm2}=K_{n\pm1}^{m\pm2}+\Delta K_n$$

$$K_{n\pm2}^{m\pm1}=K_{n\pm2}^{m\pm1}+\Delta K_n$$

$$K_{n\pm2}^{m\pm2}=K_{n\pm2}^{m\pm2}+\Delta K_n$$

Specifically, assuming that the correction amount for the central $K_n^m$ is 3, the compensation amount adjacent to $K_n^m$ in the map is corrected by 2 and the adjacent-but-one compensation amounts are corrected by 1 in the same direction. If $K_2$ is smaller than 1, the subtraction is effected at step 503 in a manner similar to the preceding case and the result is stored in RAM 107.

In the embodiment under consideration, the hatched region shown in FIG. 15 in relation to the block 496 for deciding the stable combustion of the engine is specified. nevertheless, according to the present invention, it is basically sufficient if it can be decided that the engine combustion is comparatively stable or not. This purpose may be attained also by deciding the engine combustion by use of at least one or a combination of two or more parameters indicating the injection pulse duration T, the intake air amount Q, the engine speed N and the engine water temperature. The embodiments of the invention shown in FIGS. 7 to 11 and FIGS. 16 to 18 are realized by modifying the block 496 respectively.

Figure 8:
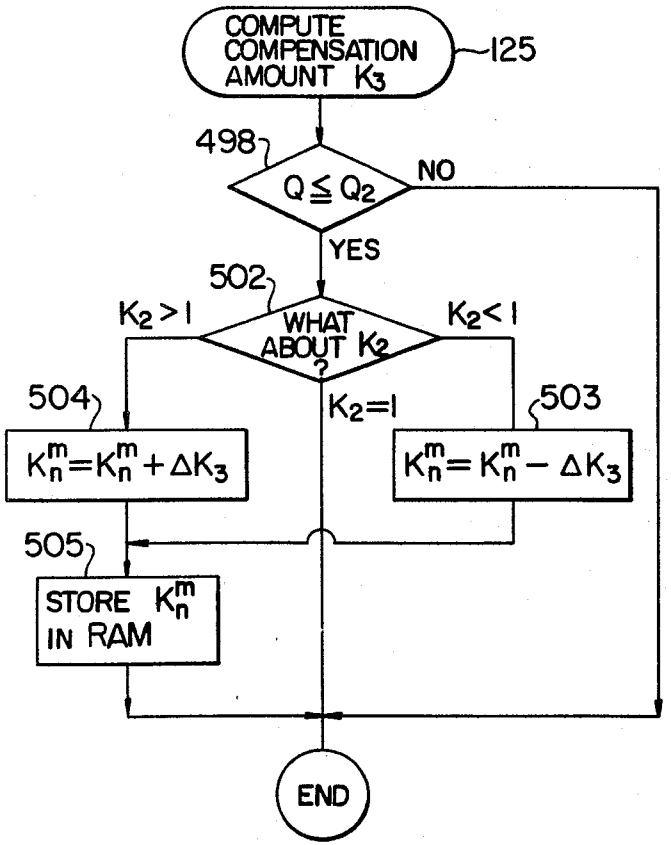

In FIG. 7, the process is started by deciding whether or not the injection pulse duration T is within a set range ($T_0\leqq T\leqq T_2$). In FIG. 8, on the other hand, the process is started by deciding whether or not the intake air amount Q to the engine is within a set range ($Q\leqq Q_2$).

Figure 9:
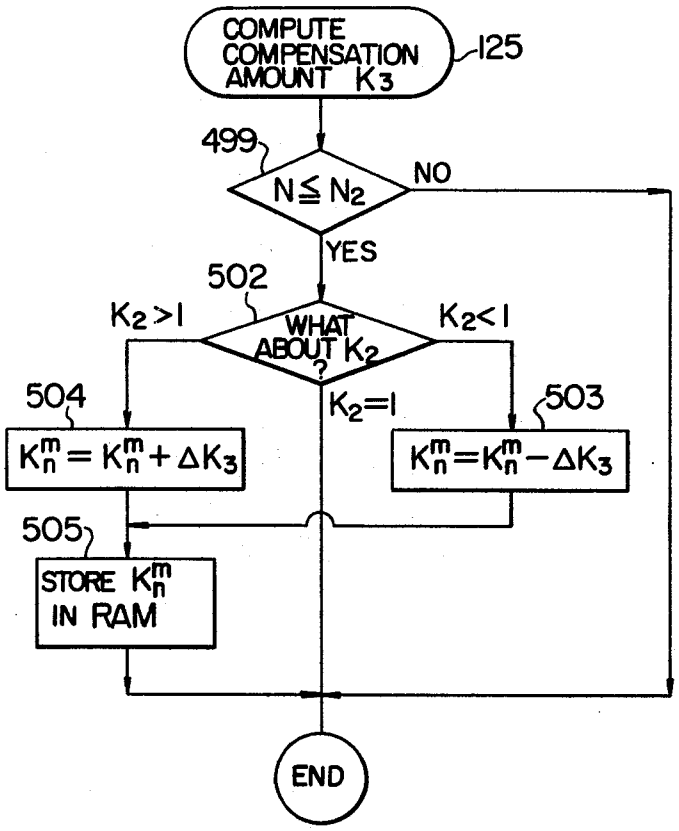

In FIG. 9, the process is started by deciding whether or not the engine speed N is included within a set range ($N=N_2$). In any case, the decision is made by use of a single parameter. The injection pulse duration T may be replaced by a value correlated therewith.

Figure 11:
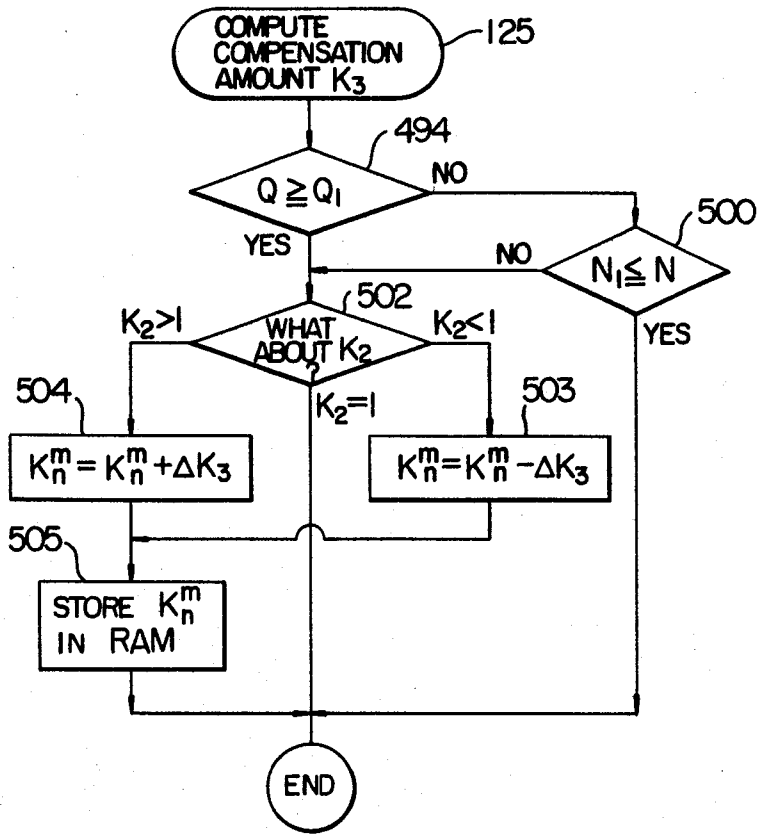
Figure 10:
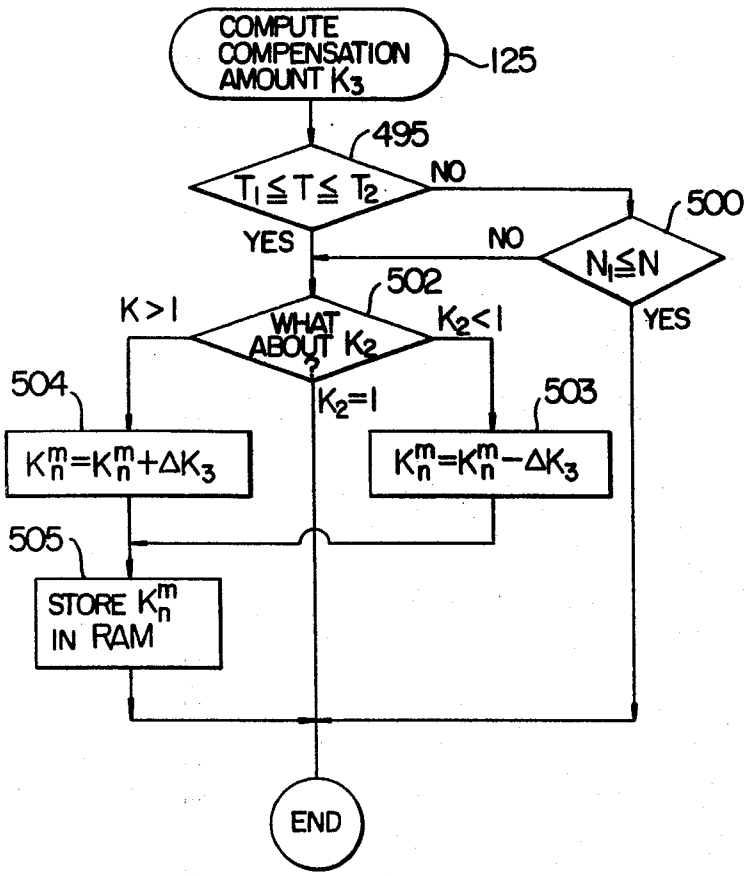

In FIG. 10, the injection pulse duration T and the engine speed N are used as parameters. If the pulse duration T is within the set range ($T_1\leqq T\leqq T_2$) or if the pulse duration T takes a value outside of this range ($T<T_1$ or $T>T_2$) and the engine speed N is lower than $N_1$, it is decided that the engine is substantially idling and the compensation amount is stored. In FIG. 11, the intake air amount Q and the engine speed N are used as parameters, so that if the intake air amount Q is a predetermined value or more ($Q>Q_1$), or if it is smaller than the predetermined value $Q_1$ and the engine speed N is lower than a predetermined value $N_1$ ($N<N_1$), it is decided that the engine is substantially idling and the compensation amount is stored.

In FIGS. 7 to 11, identical steps are shown by identical reference numerals and are not described repeatedly.

Figure 16:
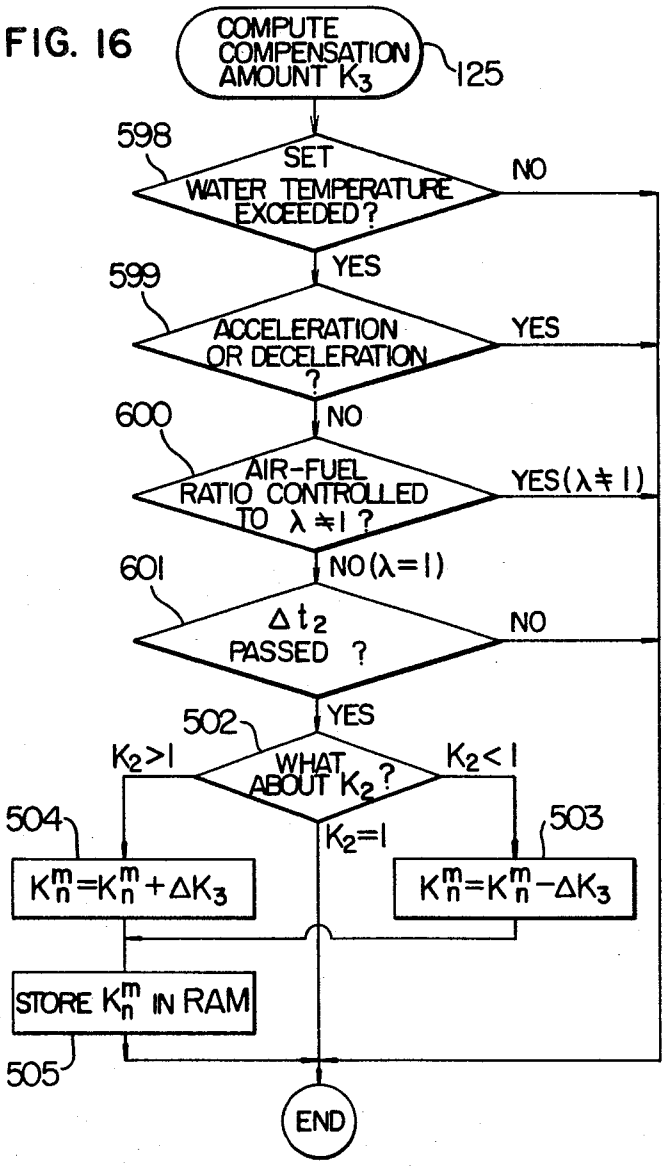
FIGS. 16 to 18 are flowcharts showing still other embodiments of the present invention.
Figure 18:
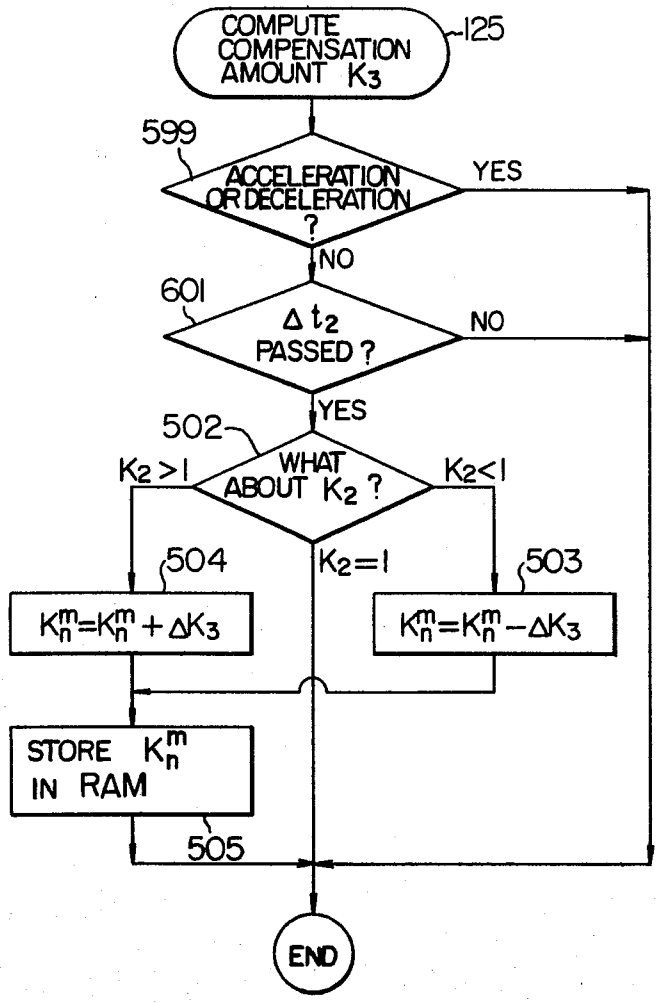
Figure 17:
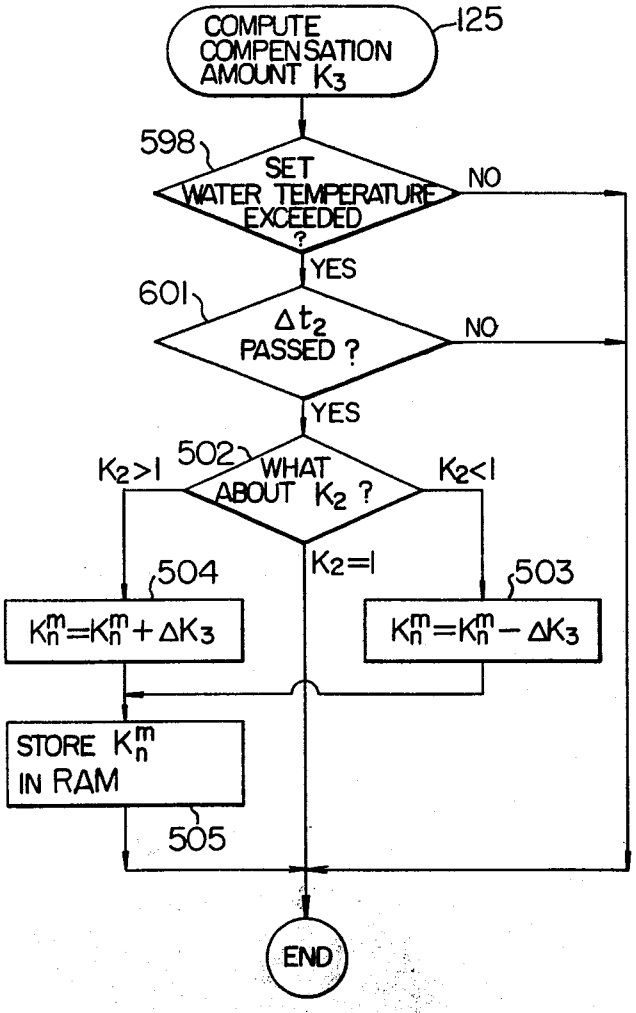

In FIG. 16, step 598 is for deciding whether or not the water temperature from the water temperature sensor 13 for measuring the temperature of the engine cooling water is higher than a set value, and if it is lower than the set value, the step 125 is completed, while if it is higher than the set level, the process is passed to the step 599. At step 599, it is decided whether or not the engine is being accelerated or decelerated, and if the engine is accelerated or decelerated, the step 125 is completed. If the engine is neither accelerated nor decelerated, on the other hand, the process proceeds to step 600. The decision on acceleration or deceleration is made by the change of the engine speed (differentiation) or the intake air amount. It may alternatively be decided by the magnitude of the basic fuel injection amount $t=F\times Q/N$ (F: Constant, Q: Intake air amount, N: Engine speed) or by the lapse of a predetermined length of time such as five seconds after the turning on or off of the switch for detecting the closed-up position of the throttle position 10 (idle switch). Step 600 decides whether or not the air-fuel ratio is controlled to other than the stoichiometric value ($\lambda\neq1$), namely, whether or not the air-fuel ratio is forcibly controlled to rich or lean side. If the air-fuel ratio is controlled to $\lambda\neq1$, the step 125 is completed, while if it is controlled to $\lambda=1$, the process proceeds to step 601. Step 601 meters the lapse of time to decide whether or not the unit time $\Delta t_2$ has passed after the air-fuel ratio is controlled to $\lambda=1$, and if the time $\Delta t_2$ has not yet passed, the processing step 125 is completed, while if it has been passed, the process is passed to step 502 thereby to decide the value $K_2$.

the processing of the value $K_3$ in FIG. 16 may be simplified as shown in FIGS. 17 and 18. the processing of FIG. 17 is such that the value of the compensation amount $K_2$ is checked only by detecting the lapse of the unit time $\Delta t_2$ after the cooling water temperature has exceeded the set value at step 598, so that the value $K_3$ is corrected and stored as required in a manner similar to that shown in FIG. 16. The processing in FIG. 18, on the other hand, is such that the value $K_3$ is corrected and stored only by detecting the lapse of the unit time $\Delta t_2$ after detection of the steady operation at step 599.

The intake air amount used as an engine parameter for storing the compensation amount $K_3$ divided in the RAM 107 in the above-described embodiment may be replaced with equal effect by the opening of the intake negative pressure throttle valve or the like.

In the aforementioned embodiment, the value $K_3$ is computed and rewritten (stored) each time of the lapse of the unit time $\Delta t_2$ at step 125 for computing and storing the compensation amount $K_3$. In place of this process, the value $K_3$ may be computed and rewritten each time of the engine unit revolutions $\Delta N$, in which case the unit revolutional speed $\Delta N$ of 30 revolutions is desirable for engine steady operation and 20 revolutions for the transient state such as acceleration or deceleration for satisfactory control response accuracy.

We claim:

1. A method of engine air-fuel ratio control comprising the steps of:

producing integration data by integrating the output signal of an air-fuel ratio sensor;

comparing a reference value of integration data with the integration data obtained by the previous integration step, when under predetermined stable operating conditions;

increasing the fuel injection amount compensation data by a predetermined amount when said produced integration data is on a lean side;

reducing said fuel injection amount compensation data by a predetermined amount when said produced integration data is on a rich side;

storing said fuel injection amount compensation data in a memory in accordance with the engine conditions;

computing the basic fuel injection amount from the engine speed and the intake air amount;

reading a fuel injection amount compensation data from said memory in accordance with the engine conditions; and correcting said basic fuel injection amount by said produced integration data and said fuel injection amount compensation data read out, thereby controlling the air-fuel ratio of the engine, but delaying the correcting step for a predetermined period of time after the engine operating condition changes from an unstable condition to a stable condition.

2. An air-fuel ratio control system for an internal combustion engine comprising:

an air-fuel ratio sensor for detecting an air-fuel ratio;

engine operating sensor means for detecting an engine operating condition to generate an output signal, including means for detecting at least one of a plurality of data comprising width of fuel injection pulse corresponding to the fuel amount supplied to said engine, amount of intake air, cooling water temperature and engine speed;

fuel injection valve means for injecting fuel to the engine; and microcomputer means for receiving signals of said air-fuel ratio sensor and said engine operating sensor means and for supplying fuel injection pulses to said fuel injection valve means;

when said microcomputer means includes a memory for storing learning data at each location corresponding to each engine operating condition detected by said sensor means, means for treating the output signal of said air-fuel ratio sensor and generating a correction signal, means for discriminating whether the combustion condition of said engine is stable by resorting to at least one of said data, means for correcting learning data by the correction signal at a location in said memory corresponding to an engine operating condition detected by said sensor means, and means for stopping the correcting operating for a predetermined period of time after the engine combustion condition changes from unstable to stable.

3. A method of engine air-fuel ratio control comprising the steps of:

discriminating to decide whether an engine operating condition is stable by sampling at least one of a plurality of engine operating parameters including duration of injection pulse designation fuel amount supplied to the engine, intake air amount, cooling water temperature and engine speed;

integrating the output signal of an air-fuel ratio sensor;

in response to an indication from said discriminating of a stable operating condition of said engine, updating stored engine operating condition compensation data, including data of said integrated signal, corresponding to engine operating parameters in a memory, but preventing the updating for a predetermined period of time after said engine changes from an unstable operating condition to a stable operating condition; and reading out engine operating condition compensation data from said memory in correspondence with current engine operating parameters to correct the air-fuel ratio of the air-fuel mixture supplied to the engine.

4. An engine air-fuel ratio control apparatus comprising:

discriminating means for deciding whether an engine operating condition is stable by sampling at last one of a plurality of engine operating parameters including duration of injection pulse designation, fuel amount spplied to the engine, intake air amount, cooling water temperature and engine speed;

integrating means for integrating an output signal of an air-fuel ratio sensor;

updating means for responding to a stable operating condition indication from said discriminating means to update engine operating condition compensation data stored in a memory which correspond to engine operating parations, but not updating for a predetermined period of time after the discriminating means indicates a change from an unstable operating condition to a stable condition;

reading-out means which reads out from said memory engine operating condition compensation data corresponding to current engine operating parameters to correct the air-fuel ratio of the air-fuel mixture supplied to the engine.

5. An engine air-fuel ratio control apparatus comprising:

producing means for producing integration data by integrating the output of an air-fuel ratio sensor;

comparing means for comparing a reference valve of integration data with the integration data from the producing means, when under predetermined stable operating conditions;

control means responsive to the comparing means for increasing the fuel injection amount compensation data by a predetermined amount when said produced integration data is on a lean side, reducing said fuel injection amount compensation data by a predetermined amount when said produced integration data is on a rich side, and, in either case, storing said fuel injection amount compensation data in a memory in accordance with the engine conditions;

computing means for computing the basic fuel injection amount from the engine speed and the intact air amount;

reading means for reading fuel injection amount compensation data from said memory in accordance with the engine conditions; and correcting means for correcting said basic fuel injection amount by said produced integration data and said fuel injection amount compensation data read out, thereby controlling the air-fuel ratio of the engine, but delaying the correcting for a predetermined period of time after the engine operating condition changes from unstable to stable.

6. A method according to claim 1, wherein said predetermined stable operating conditions are attained when the temperature of the engine cooling water has exceeded a set value or a predetermined length of time has passed after the reaching of said set value.

7. A method according to claim 1, further comprising the step of deciding selected one of the acceleration and deceleration of the engine, said predetermined stable operating conditions including none of the acceleration, deceleration and a predetermined time length following said acceleration and deceleration.

8. A method according to claim 1, wherein said predetermined stable operating conditions are not during a time when the set target air-fuel ratio of the engine is controlled to a selected one of a richer ($\lambda<1$) or leaner side ($\lambda>1$) than a stoichiometric air-fuel ratio, and a predetermined time length following the completion of said air-fuel ratio control.

9. A method according to claim 3, including steps of:

determining temperature compensation data $K_1$ by using data for the cooling water temperature and intake air temperature;

determining a basic fuel injection amount t from current engine speed and intake air amount; and determining an object fuel injection amount $T=t\times K_1K_2K_3$ by the read-out compensation data including current integrated-signal data $K_2$ and injection amount compensation data $K_3$.

10. A apparatus as in claim 4, further comprising:

first determining means for determining temperature compensation data $K_1$ by using data for the cooling water temperature and intake air temperature;

second determining means for determining a basic fuel injection amount t from current engine speed and intake air amount; and third determining means for determining an object fuel injection amount $T=tK_1K_2K_3$ by the read-out compensation data including current integrated-signal data $K_2$ and injection amount compensation data $K_3$.

11. An apparatus according to claim 5, wherein:

said predetermined stable operating conditions are attained when the temperature of the engine cooling water has exceeded a set value or a predetermined length of time has passed after the reaching of said set value.

12. An apparatus according to claim 5, further including:

deciding means for deciding when the engine is accelerating or decelerating such that said predetermined stable operating conditions exclude any acceleration, deceleration and a predetermined time length following said acceleration and deceleration.

13. An apparatus according to claim 5, wherein:

said predetermined stable operating conditions do not include a time when the set target air-fuel ratio of the engine is controlled to a selected one of a richer ($\lambda<1$) or leaner ($\lambda>1$) side than a stoichiometric air-fuel ratio, and a predetermined time length following the completion of said air-fuel ratio control.

* * * * *